US007156103B2

(12) United States Patent
Coleman

(10) Patent No.: US 7,156,103 B2
(45) Date of Patent: Jan. 2, 2007

(54) BEAD, A TOOL AND A METHOD FOR APPLYING THE BEAD TO HAIR

(76) Inventor: Dorothy Coleman, 1930 Coach Dr., Naperville, IL (US) 60565

( * ) Notice: Subject to any disclaimer, the term of this patent is extended or adjusted under 35 U.S.C. 154(b) by 215 days.

(21) Appl. No.: 10/389,218

(22) Filed: Mar. 14, 2003

(65) Prior Publication Data

US 2004/0177859 A1 Sep. 16, 2004

(51) Int. Cl.
*A45D 24/00* (2006.01)
*A45D 8/12* (2006.01)

(52) U.S. Cl. ..... 132/200; 132/275

(58) Field of Classification Search ..... 132/212, 132/200, 275, 273; 223/48, 44, 99, 104; 24/115 R See application file for complete search history.

(56) References Cited

U.S. PATENT DOCUMENTS 4,307,908 A * 12/1981 Donaldson ..... 132/200
4,315,362 A * 2/1982 Pigford et al. ..... 29/433
5,456,271 A * 10/1995 Legette ..... 132/212
5,558,105 A * 9/1996 Rosenwinkel et al. ..... 132/212
5,664,707 A * 9/1997 Spector ..... 223/48
5,687,751 A * 11/1997 Villani ..... 132/200
5,848,453 A * 12/1998 Racodon ..... 16/431
5,881,738 A * 3/1999 Villani ..... 132/212
5,967,151 A * 10/1999 Villani et al. ..... 132/200
6,035,864 A * 3/2000 Kennedy ..... 132/273
6,314,969 B1 * 11/2001 Lacause ..... 132/275
2004/0145892 A1 * 7/2004 Kellough ..... 362/208

* cited by examiner

*Primary Examiner*—John J. Wilson
*Assistant Examiner*—Robyn Doan
(74) *Attorney, Agent, or Firm*—Patents + TMS, P.C.

(57) ABSTRACT

A bead, a tool and a method are provided for applying the bead to hair. The bead may be constructed from a pliant and/or soft and/or resilient material, such as for example, rubber, foam, or the like. The bead may be placed around the tool which may hold one or more strands of the hair in a position for placement of the bead onto the hair. The bead may then be moved along a body of the tool until the bead is placed onto the strands of hair. The pliancy and/or softness and/or resiliency of the bead may enable the bead to be worn adjacent to the scalp without causing discomfort to a user. The bead may also be worn by a user during activities, such as, for example, running or like activity.

13 Claims, 2 Drawing Sheets

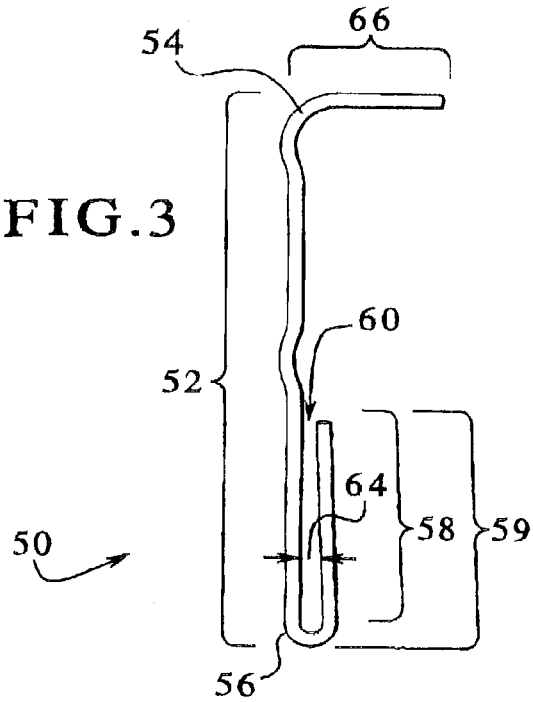
FIG.3
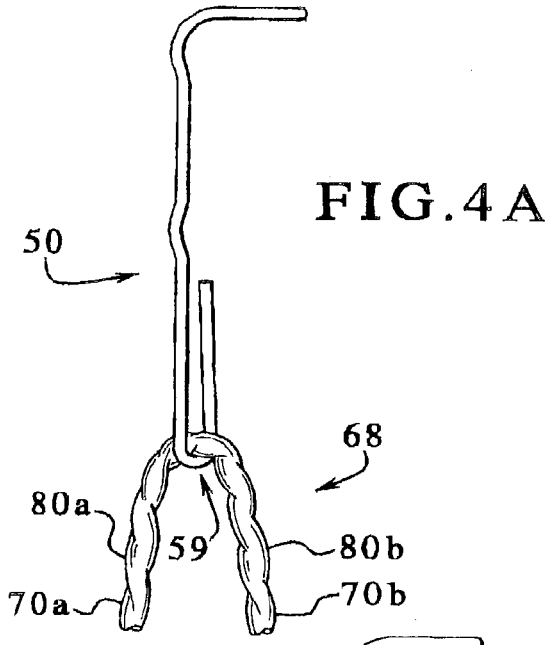
FIG.4A
FIG.4B
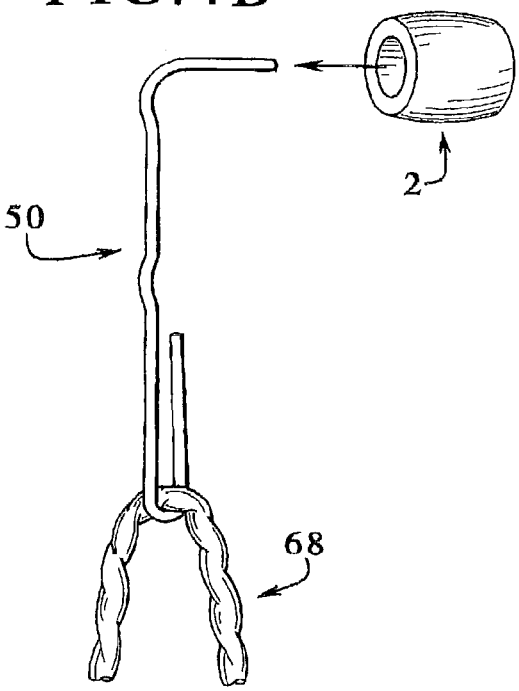
FIG.4C
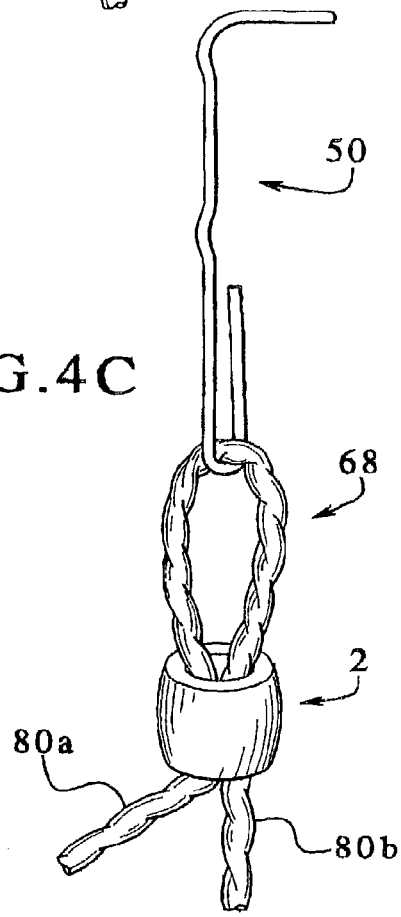

BEAD, A TOOL AND A METHOD FOR APPLYING THE BEAD TO HAIR

BACKGROUND OF THE INVENTION

The present invention generally relates to a bead, a tool and a method for applying the bead to hair. More specifically, the present invention relates to a bead which may be constructed from a pliant material. The tool may have a hooked end which may secure the hair as the bead is placed onto the hair. Because of the resiliency of the material from which the bead is constructed, the bead may be positioned on the hair adjacent to a scalp of a user.

It is, of course, generally known to wear beads in the hair of an individual to provide, for example, decoration to the hair. The bead is generally constructed from a hard material, such as, for example, a hard plastic, wood, or the like. The bead has a tubular shape and is, for example, slipped over one or more strands of hair. The bead, or a collection of beads worn in the hair, may then provide the individual, male or female, with a desired appearance.

However, applying the bead to the hair may be a difficult task. Specifically, the individual or user must manually hold one or more strands of hair and attempt to pass the strands through a hole in the bead. Choosing a less than appropriate amount of strands may cause the bead to unintentionally fall out of the hair while being worn. Choosing a greater than appropriate amount of hair may cause difficulty in passing the strands through the hole and may also cause damage to hair which contacts the bead during the application. Moreover, a difference in length between individual strands of hair may also cause difficulty in placing the bead around the strands of hair.

Further, the user may prefer to wear numerous beads in his or her hair. More specifically, the user may desire to place several beads adjacent to each other on the same strand of hair in, for example, a "stacked" arrangement. Placement of all of the beads onto the strand may be a time-consuming and labor-intensive task.

When worn, the beads may present a number of problems because of the rigidity of the material from which the bead is constructed. For example, during an activity, such as, for example, running, the hair of the user may be moving. The bead may then contact, for example, a face of the user, causing discomfort or pain to the user.

In another example, the rigidity of the bead prevents the user from positioning the bead along the hair in close proximity to the scalp because of a potential for discomfort or pain when the bead is pressed toward the scalp. As a result, the user is faced with limited options for placement of the beads, and, therefore, limited with respect to a number of different appearances created by wearing the beads.

A need, therefore, exists for a bead, a tool and a method for applying the bead to hair which enables the bead to be applied to the hair in a convenient manner; which enables the bead to be worn adjacent to the scalp; and which enables the user to wear the bead during an activity.

SUMMARY OF THE INVENTION

The present invention relates to a bead, a tool and a method for applying the bead to hair. The bead may be constructed from a pliant material, such as for example, rubber, foam, or the like. The bead may be placed around the tool which may hold the hair in a position for placement of the bead onto the hair. The bead may then be moved along a body of the tool until the bead is moved onto a strand of the hair. A resiliency of the bead may enable the bead to be worn adjacent to the scalp without causing discomfort to a user.

To this end, in an embodiment of the present invention, a bead is provided for decorating hair. The bead has a top surface. The bead also has a bottom surface. In addition, the bead has a body defined by a wall defining an interior wherein the wall has a thickness wherein a radius of the interior is less than or equal to the thickness of the wall and further wherein the wall is constructed from a pliant material.

In an embodiment, the pliant material is rubber.

In an embodiment, the pliant material is foam.

In an embodiment, the top surface, the bottom surface and the wall are integrally formed.

In another embodiment of the present invention, a tool is provided. The tool has a barrel having a length defined between a first end and a second end wherein the length is substantially linear. The tool also has a first section extending from the barrel at the first end wherein the first section has a length defined between a first end and a second end wherein the second end of the first section is positioned adjacent to the barrel. In addition, the tool has a second section extending from the second end of the barrel wherein the second section extends in a direction at an angle to the barrel wherein the barrel, the first section and the second section are integrally formed.

In an embodiment, the angle at which the second section extends is an acute angle.

In another embodiment of the present invention, a bead is provided for decorating hair. The bead has a wall defining an interior wherein the wall has an outside perimeter defining a first diameter and further wherein the wall extends from a first end to a second end and further wherein the wall is constructed from a pliant material. The bead also has indentations in the wall wherein the indentations form a second diameter which is less than the first diameter.

In an embodiment, the pliant material is rubber.

In an embodiment, the pliant material is foam.

In another embodiment of the present invention, a method is provided for applying a bead to hair. The method has the steps of: providing the bead having a length defined between a first end and a second end wherein the bead has a wall defining an interior sized to receive the hair and a first opening at the first end and a second opening at the second end; providing a tool having a barrel defined between a first end and a second end wherein a hook extends from the first end of the tool; placing the hair around the hook; placing the bead around the second end of the barrel; and placing the barrel through the bead.

In an embodiment, the method further has the step of placing the hook through the bead.

In an embodiment, the method further has the step of placing the bead at a desired position along the hair.

In an embodiment, the wall is constructed from a pliant material.

In an embodiment, the bead has indentations dividing the bead into spaced sections.

In an embodiment, the barrel and the hook are integrally formed.

It is, therefore, an advantage of the present invention to provide a bead, a tool and a method for applying the bead to hair.

Another advantage of the present invention is to provide a bead, a tool and a method for applying the bead to hair which may prevent discomfort to a user when the bead is worn and contacts, for example, a head of the user.

Yet another advantage of the present invention is to provide a bead, a tool and a method for applying the bead to hair which enables a user to place the bead on the hair adjacent to the scalp.

Still another advantage of the present invention is to provide a bead, a tool and a method for applying the bead to hair which may provide a bead which is constructed from an inexpensive material.

A further advantage of the present invention is to provide a bead, a tool and a method for applying the bead to hair which may enable the user to perform various activities while wearing the bead.

Yet another advantage of the present invention is to provide a bead, a tool and a method for applying the bead to hair wherein the bead is simple to manufacture.

Another advantage of the present invention is to provide a bead, a tool and a method for applying the bead to hair wherein the tool is simple to manufacture.

Still another advantage of the present invention is to provide a bead, a tool and a method for applying the bead to hair wherein the bead may be shaped to create an appearance of two or more beads in a stacked arrangement.

Another advantage of the present invention is to provide a bead, a tool and a method for applying the bead to hair wherein the method is convenient for a user.

Additional features and advantages of the present invention are described in, and will be apparent from, the detailed description of the presently preferred embodiments and from the drawings.

BRIEF DESCRIPTION OF THE DRAWINGS

FIG. 3 illustrates a tool which may be used to apply a bead to hair in an embodiment of the present invention.

FIGS. 4A, 4B and 4C illustrate a method for applying a bead to hair in an embodiment of the present invention.

DETAILED DESCRIPTION OF THE PRESENTLY PREFERRED EMBODIMENTS

The present invention generally relates to a bead, a tool and a method for applying the bead to hair. The bead may be constructed from a pliant material, such as, for example, foam, rubber, or the like. As a result, the bead may not cause discomfort to a user when the bead is worn and/or presses against, for example, a head or face of the user. The tool may have a hooked end which may hold a strand of hair in position for placement of a bead onto the hair. The bead may be placed around an end of the tool opposite the hair and may be moved along a body of the tool until the bead is secured around the strand of hair.

Figure 1A:
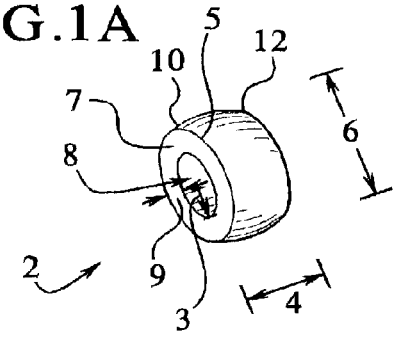
FIG. 1A illustrates a perspective view of a bead in an embodiment of the present invention.

Referring now to the drawings wherein like numerals refer to like parts, FIG. 1A illustrates a bead 2 in an embodiment of the present invention. The bead 2 may have a length 4 and a width 6. The bead may also have a wall 7 having a thickness 9. The bead 2 may have a tube-like shape defining an interior 8. A radius 3 of the interior 8 may be less than or equal to the thickness 9 of the wall 7. Hair may be placed through the interior 8 of the bead 2 from a first end 10 to a second end 12 to apply the bead 2 to the hair.

The bead 2 may be constructed from a pliant and/or soft and/or resilient material, such as, for example, rubber, foam, or the like. In an embodiment, a perimeter 5 of the wall 7 may be covered with, for example, cloth. Moreover, the bead 2 may bend when pressure is applied to the bead 2. For example, a user holding the bead 2 between, for example, a thumb and index finger may bend the bead 2 by applying pressure with the thumb and index finger. Accordingly, the resiliency and/or softness of the bead 2 may enable the bead 2 to be worn during various activities because the softness of the bead may prevent discomfort to the user if the bead 2 contacts, for example, the face of the user. In an example, the bead 2 may be worn by the user while the user is running, without a potential for discomfort if the bead 2 contacts, for example, the face or other body part of the user during the activity.

In addition, the user may position the bead 2 onto the hair of the user along any position on the hair. For example, the user may position the bead 2 on the hair adjacent to the scalp of the user without a potential for discomfort caused by the bead 2. The user may also position the bead 2 at a point along the hair furthest from the scalp without a potential for discomfort, or at any other position on the hair between the scalp and the point furthest from the scalp.

Figure 1C:
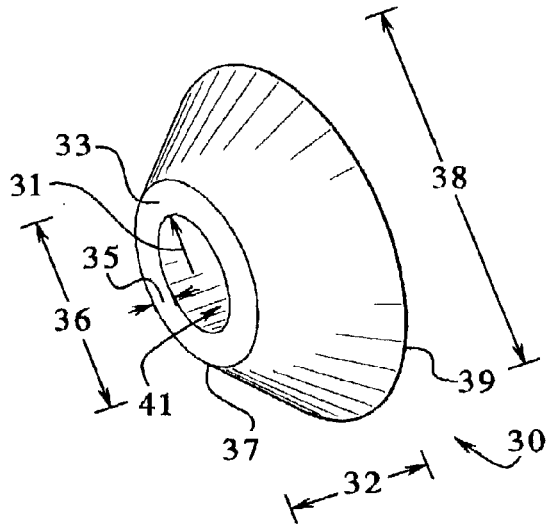
FIG. 1C illustrates a perspective view of a bead in an embodiment of the present invention.
Figure 1B:
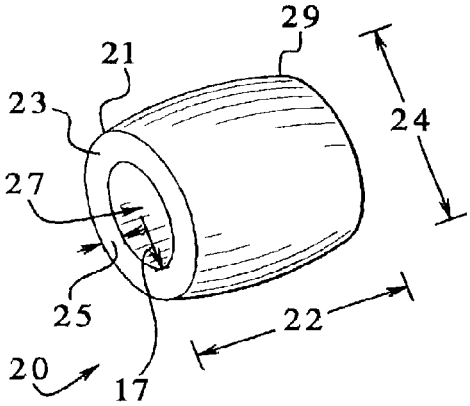
FIG. 1B illustrates a perspective view of a bead in an embodiment of the present invention.

FIG. 1B illustrates a bead 20 in another embodiment of the present invention. The bead 20 may have a length 22 and a width 24. The bead 20 may also have a wall 23 having a thickness 25. The wall 23 may be constructed from a pliant and/or soft and/or resilient material, such as, for example, rubber, foam or the like. The bead 20 may also have an interior 27. A radius 17 of the interior 27 may be less than or equal to the thickness 25 of the wall 23.

FIG. 1C illustrates a bead 30 which may have a length 32 and a wall 33 having a thickness 35. The bead 30 may have a width 36 at a first end 37 and a width 38 at a second end 39. The width 36 may be less than the width 38. The bead 30 may also have an interior 41 extending from the first end 37 to the second end 39. A radius 31 of the interior 41 may be less than or equal to the thickness 35 of the wall 33.

Figure 2:
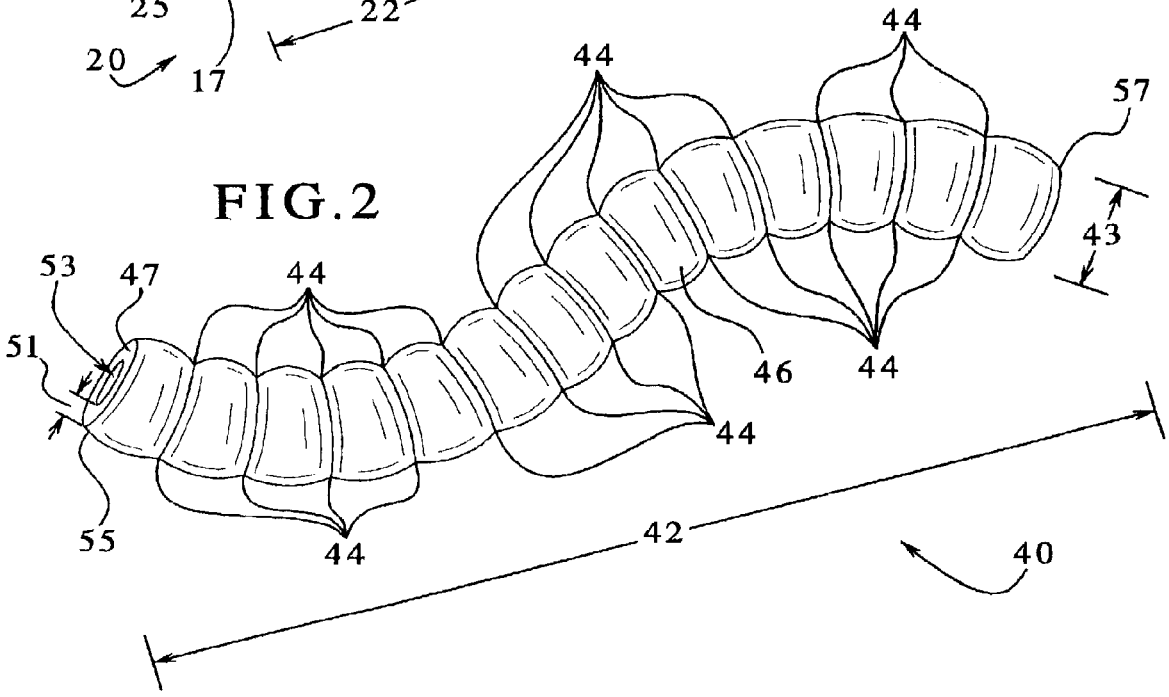
FIG. 2 illustrates a perspective view of a bead in an embodiment of the present invention.

FIG. 2 illustrates a bead 40 in another embodiment of the present invention. The bead 40 may have a length 42 and a width 43. The bead 40 may also have a wall 47 having a thickness 51. In addition, the bead 40 may have an interior 53 extending from a first end 55 to a second end 57. The bead 40 may be constructed from a soft and/or pliant and/or resilient material, such as, for example, rubber, foam, or the like. As a result, the bead 40 may be flexible and may bend in conformity with the hair of the user. Moreover, the soft and/or pliant and/or resilient material may enable the bead 40 to be worn adjacent the scalp without a potential for discomfort or pain if the bead 40 is pressed toward the scalp. The bead 40 may also be worn during activities, such as running, jumping or other vigorous activities, without a potential for discomfort if the hair of the user is moving and contacts, for example, the face of the user. In an embodiment, an exterior surface 46 of the bead 40 may be covered with a cloth.

In an embodiment, the bead 40 may be integrally formed. The bead 40 may have ridges 44 along the exterior surface 46 of the bead 40. When the bead 40 is worn, the ridges 44 may provide the bead 40 with an appearance similar to two or more smaller-sized beads which may be stacked along a strand of hair. For example, the bead 40 illustrated in FIG. 2 may provide the appearance of fourteen smaller beads in a stacked arrangement. The bead 40 may thus eliminate an amount of labor required to apply a number of beads along one or more strands of hair in a stacked arrangement. The bead 40 may also eliminate an amount of labor that may be required to remove a number of beads from one or more strands of hair.

Referring now to FIG. 3, a tool 50 is illustrated which may be used to secure a bead around a strand of hair. The tool 50 may be constructed from metal, wood, plastic, wire, or the like. The tool 50 may have a cylindrical rod 52 which may be defined between a first end 54 and a second end 56. The rod 52 may have a bend at the first end 54 and a bend at the second end 56. A section 58 of the tool 50 at the second end 56 may be positioned toward the rod 52, creating a "hooked section" 59. As a result, a space 60 may exist between the section 58 and the rod 52. The space 60 may have a width 64 which may be less than a width of a bead which may be placed around the tool 50, such as, for example, the bead 2 illustrated in FIG. 1A. The tool 50 may also have a section 66 which may be positioned at, for example, a right angle, to the rod 52 of the tool 50.

FIGS. 4A, 4B and 4C illustrate a method for applying a bead to hair. For the purposes of this example, the illustrated bead is the bead 2 of FIG. 1A. In a first step, as seen in FIG. 4A, one or more strands of hair 68 may be placed within the hooked section 59 of the tool 50, between the section 58 and the rod 52. The strands of hair 68 may be folded around the hooked section 59 and may be divided into sections 80*a* and 80*b*. In an embodiment, the strands of hair 68 may be held by the user at or near points 70*a*, 70*b* to secure the strands of hair 68 around the tool 50.

In a next step, illustrated in FIG. 4B, the bead 2 may be placed around the tool 50. More specifically, the bead 2 may be placed around the section 66 of the tool 50 wherein the section 66 extends through the interior 8 of the bead 2. The user may then move the bead 2 along the rod 52 of the tool 50. The interior 8 of the bead 2 may be sized to receive the rod 52 as well as the section 58.

FIG. 4C illustrates a further step of the method in which the hooked section 59 is moved through the interior 8 of the bead 2. The strands of hair 68, which may be folded around the hooked section 59 may also move through the interior 8. After the strands of hair 68 move through the bead 2, the user may remove the strands of hair 68 from the hooked section 59. The user may then pull the strands of hair 68 until one of the portions 80*a* or 80*b* moves completely through the interior 8 of the bead 2. Next, the user may move the bead 2 along the strands of hair 68 to a desired position on the hair 68.

The pliant and/or soft and/or resilient material used to construct the bead of the present invention may provide the user with a decoration for hair which is also comfortable to wear. Specifically, if the bead is positioned adjacent the scalp or otherwise pressed toward the scalp, the soft material of the bead prevents discomfort or pain to the user. Accordingly, the bead may be worn while a user rests his or her head on, for example, a pillow or other surface. The soft material may also prevent discomfort or pain during an activity during which the hair may be moving and may contact, for example, the face of the user.

The bead 40 having ridges 44 may provide the user with the appearance of two or more smaller beads on the hair. Thus, the bead 40 may eliminate an amount of time associated with achieving the same appearance via placement of several beads in the hair. In general, the tool 50 and method of the present invention may reduce an amount of time associated with placement of one or more beads on the hair.

It should be understood that various changes and modifications to the presently preferred embodiments described herein will be apparent to those skilled in the art. Such changes and modifications may be made without departing from the spirit and scope of the present invention and without diminishing its attendant advantages.

I claim:

1. A bead for decorating hair, the bead comprising:

a circular wall defining an interior wherein the wall has an outside perimeter defining a first diameter wherein the wall has an inside perimeter defining a second diameter wherein the wall has a thickness defined between the first diameter and the second diameter and further wherein the wall extends from a first end to a second end to define a length wherein the thickness is continuously uniform between the first end and the second end and further wherein the second diameter increases parabolically to a maximum diameter wherein the maximum diameter is greater than the first diameter and further wherein the maximum diameter is located at a midpoint intermediate the first end and the second end wherein the inside perimeter is continuously uniform between the first end and the second end and further wherein the length is greater than the first diameter and the second diameter and further wherein the wall is constructed from a pliant material.

2. The bead of claim 1 wherein the pliant material is rubber.

3. The bead of claim 1 wherein the pliant material is foam.

4. A method for applying a bead to hair, the method comprising the steps of:

providing the bead having a length defined between a first end and a second end wherein the bead has a circular wall defining an interior wherein the interior of the wall is sized to receive the hair and a first opening at the first end and a second opening at the second end wherein the first opening and the second opening extend through the length of the bead having a continuously uniform diameter with a circular cross-section and further wherein an exterior wall of the bead parabolically and uniformly increases in between the first end and the second end toward a point intermediate the first end and the second end;

providing a tool having a rod defined between a first end and a second end wherein a first section extends from the rod at the first end wherein the first section is shorter than the rod and wherein the first section is defined by a length between a first end and a second end wherein the first end of the first section is at a first distance from the rod and the second end of the first section is at a second distance from the rod and further wherein the first distance is greater than the second distance;

placing the hair around the first section;

placing the first opening of the bead around the second end of the rod; and placing the rod through the first opening and the second opening of the bead.

5. The method of claim 4 further comprising the step of: placing the first section through the bead.

6. The method of claim 4 further comprising the step of: placing the bead at a desired position along the hair.

7. The method of claim 4 wherein the wall is constructed from a pliant material.

8. The method of claim 4 wherein the bead has indentations dividing the bead into spaced sections.

9. The method of claim 4 wherein the rod and the first section are integrally formed.

10. A bead for decorating hair, the bead comprising:

a top surface having a circular cross-sectional surface defining a wall wherein the top surface has a first opening defined by a first interior diameter and a first exterior diameter forming a thickness of the wall;

a bottom surface having a circular cross-sectional surface wherein the bottom surface has a second opening defined by a second interior diameter and a second exterior diameter wherein a passageway is formed between the top surface and the bottom surface and further wherein the first interior diameter and the second interior diameter are the same and the first exterior diameter and the second exterior diameter are the same and further wherein the passageway has a continuously uniform interior diameter between the top surface and the bottom surface; and a body between the top surface and the bottom surface wherein the body is defined by an exterior wall having a surface that uniformly tapers between the top surface and the bottom surface wherein the exterior surface has a maximum diameter greater than the first exterior diameter at a midpoint intermediate the top surface and the bottom surface and further wherein the passageway is defined by the exterior wall of the body wherein the exterior wall has a thickness that is greater than or equal to one-half of the first diameter and further wherein the body is defined by a length between the top surface and the bottom surface wherein the length is greater than the first diameter and further wherein the wall is constructed from a pliant material.

11. The bead of claim 10 wherein the pliant material is rubber.

12. The bead of claim 10 wherein the pliant material is foam.

13. The bead of claim 10 wherein the top surface, the bottom surface and the wall are integrally formed.

* * * * *